United States Patent [19]

Denev et al.

[11] 4,243,520

[45] Jan. 6, 1981

[54] METHOD FOR SEPARATION OF LARGE SIZED SALT CONTAINING MINERALS

[75] Inventors: Stoyan I. Denev; Nadejda G. Davcheva, both of Sofia, Bulgaria

[73] Assignee: Knippi "Niproruda", Sofia, Bulgaria

[21] Appl. No.: 932,654

[22] Filed: Aug. 10, 1978

[51] Int. Cl.[3] ..... B03B 7/00

[52] U.S. Cl. ..... 209/10; 209/38; 241/20

[58] Field of Search ..... 209/3, 12, 38, 10; 75/24; 241/20, 24, 191, 77

[56] References Cited

U.S. PATENT DOCUMENTS

| | | | |
|---|---|---|---|
| 1,529,970 | 3/1925 | Ullrich | 209/38 X |
| 2,047,345 | 7/1936 | Weis | 209/38 X |
| 2,075,466 | 3/1937 | Queneau | 209/12 X |
| 2,276,075 | 3/1942 | Wuensch | 209/38 X |
| 3,037,711 | 6/1962 | Busingen | 209/38 X |
| 3,198,622 | 8/1965 | Herzog | 209/214 X |
| 3,770,424 | 11/1973 | Floyd | 75/24 X |
| 3,865,029 | 2/1975 | Dankoff | 209/3 X |
| 4,073,644 | 2/1978 | Dapafingos | 75/24 X |

FOREIGN PATENT DOCUMENTS

| | | | |
|---|---|---|---|
| 283811 | 7/1965 | Australia | 75/24 |
| 600395 | 7/1934 | Fed. Rep. of Germany | 209/38 |
| 702314 | 1/1954 | United Kingdom | 209/12 |

*Primary Examiner*—Robert Halper

[57] ABSTRACT

A method for separation of large-sized salt containing minerals comprises subjecting the minerals to a succession of screening, selective crumbling and screening operations. The treated fractions from the second screening are separately submitted to magnetic separation, dehydrated and the spray water recovered from dehydration of the screened fraction is processed for salt extraction.

2 Claims, 5 Drawing Figures

METHOD FOR SEPARATION OF LARGE SIZED SALT CONTAINING MINERALS

This invention relates to a method of and an apparatus for the mechanical separation of large-sized materials and aluminum-containing slags by means of selective crumbling and screening wherein the metal-aluminum content may vary over a wide range, i.e. from 1 to 99% by weight.

In metallurgical processes a large variety of products (slags, clinkers, etc.) are obtained, such products including large-sized bodies and representing a mixture of metal granules mechanically linked to non-metal inclusions. These products are treated by means of crumbling, crushing, milling and screening. The methods and equipment used heretofore have, however, the following drawbacks: The crushers are easily broken-down, the methods do not have the necessary selectivity of separation, and there occurs a too often over-milling of metal-particles, which leads to considerable losses in said metal.

Thus, for example, in the metallurgical melt of secondary aluminum alloys there is a large quantity of waste slags separated, containing, however, a high percentage of aluminum in the form of metal-inclusions and oxides.

It is known that the existing methods of treatment are of the dry-type, and the most novel of them feature the autogenous crushing of aluminum-containing slags in autogenous mills of the "AEROFALL"-type, wherein the slag is fed to the mill in separate batches, and is thereafter crushed for 8 to 10 hours. During this period, the mill is supplied with air heated to 80° C. in an appropriate heater in order to obtain a complete drying of said slag.

The mill is also supplied with steel balls, sized from 80 to 120 mm.

The small-sized product obtained is continuously separated through a lattice, mounted in the cylindrical part of the mill. In order to separate this powder-like product, powerful aspirating units comprising blowers and sleeve-type filters are used.

The resulting aluminum-metal product is periodically discharged, for which purpose the mill must be stopped, the aluminum metal pulled-out together with the steel balls, then sifted through a special grate in order to separate the balls, and finally fed back to the mill.

Though most novel, this method—as are the remaining methods—is not yet perfect, having the following fundamental drawbacks:

The process requires a complete drying of the slag and is only periodically effected; there is a great need of good dedusting connected with a sophisticated system; there are large losses of aluminum metal in the powder and the small sized oxide-products arising from the periodic discharge of the ready product; the purity of the small sized product is unsatisfactory, thus impairing its utilization; there is a necessity of separating the steel balls upon the completion of each working cycle and their return to the mill, and, finally, the mechanization and automation of the process encounter many difficulties.

The world-wide known wet processes are used only with the so-called salt-aluminum slags (i.e. low aluminum-metal content—up to 20%, small particles sized not more than 8–10 mm, and high salt content).

The purpose of these methods is to dissolve and regenerate the salts, contained in the salted-slags. The drawbacks of the known salt-methods are as follows:

the field of application is fairly restricted; there is no means of separation of metal and non-metal (oxide) fractions; the mixed aluminum product obtained is hardly useful, etc.

Among the apparatus for the mechanical separation of large-sized materials one can cite the rotary-screen units, wherein only the screening to preset sizes can be effected with an insignificant crumbling of the weaker component, while in some rotary-screen apparatus, different additional accessories must be inserted, e.g. ribs, chains, etc. These accessories can only improve the mixing of the material, its elevation to an upper grade and its self-crushing and crumbling are far from complete.

Rod-type mills are also known, wherein only the grinding of different materials can be carried out; normally these mills are grind materials having maximal sizes of 40 to 60 and 10 to 15 mm.

The main drawback of these apparatus is the incomplete crumbling and the rather difficult discharge of larger pieces. In addition, the rod-type mills are almost unable to insure selectivity of grinding or the classification of materials.

The object of this invention is to provide a method of and an apparatus for the mechanical separation of large-sized materials and aluminum-containing slags by means of simultaneous and selective crumbling and screening operations of a multilateral character, i.e. insuring the mechanical separation of large-sized minerals, products of the metallurgical processes such as slags, clinkers, etc., and more specifically, the treatment of all sorts of aluminum slags: dry, salted, etc., in order to provide means for the continuous processing and complex utilization of treated materials, insuring a good separation-selectivity and a high quality of the products obtained, the process being fully mechanized with prospects for its complete automatization.

In the method in accordance with the invention, the mechanical separation of large-sized materials and particularly of aluminum-containing slags is carried out by submitting the materials and slags to mechanical crumbling and screening under conditions of intensive water-spraying to separate the large sized (metal) fraction from the small sized (oxide) one. In the presence of iron-inclusions in the washed-out (metal) fraction, such fraction is submitted to the removal of iron inclusions by means of magnetic separation, and is thereafter dried. With aluminum-containing slags, the drying of this fraction is carried out by autogenous means, the dried aluminum-metal product being submitted to metallurgical treatment through a remelting process.

The small sized oxide-fraction, separated by means of screening, is also submitted to the removal of iron inclusions through magnetic separation, being afterwards dewatered and dried.

With the aluminum-containing slags the drying is carried out in an autogenous manner, the product being further submitted to a chemical treatment.

The water separated during the dehydration of the small sized fraction after desliming may be used as turnover fluid or—if salts are present therein—for the corresponding salt-extraction.

The apparatus according to the invention is a three-chamber cylindrical drum or body tilted along its axis, wherein the first and third chambers are made with several slotted screens with the slot-direction parallel to the movement of the material. By such a disposition of the slotted screens, jamming of the openings is successfully avoided, while insuring an adequate screening-selectivity.

The openings/or apertures are relatively small-ranging from 2 to 5 mm, but the maximum size of the material and slag fed for separation purposes is up to 300 mm. In practice, there is no apparatus known with such a material-size to slot-opening size ratio, i.e. more than 100.

The second chamber, occupying about one-half of the length of the drum has a smooth, cylindrical inner surface and features—at one of its ends (the bottom end with regard to the material-movement)—a perforated disc with a broad central opening. The chamber comprises from 3 to 10 metal rods and the perforated disc insures a better passage for the smaller particles, thus avoiding their overcrumbling. The disc also holds the crumbling rods inside the chamber. Thus, only the crushing of low-hardness mineral-inclusions is effected, i.e. oxide-fraction—without crushing the larger particles of higher hardness, that is, the mineral fraction.

To the main features of the equipment as a whole, it may be added that the change of the angle of tilt of the drum along its longitudinal axis regulates the crumbling-rate at a preset productivity value.

The method and apparatus of the invention insures the selective crumbling and screening of the products of the metallurgical-process, minerals, etc. providing additional quantities of metals and other raw materials at a low investment rate and insuring an efficient separation of aluminum metal from aluminum and other compounds, as well as the obtaining of high quality aluminum and iron products.

The advantages of the method and apparatus of the invention are as follows: both have a wide field of application, being able to insure the treatment of different materials containing components of different hardness, the treatment of metallurgical products and some minerals, to insure the reprocessing of all sorts of aluminum slags (dry, salted, etc.) containing aluminum-metal), and furthermore, providing the possibility for a continuous technological process and complex utilization of mechanically-separated materials and aluminum slags.

The method when applied to the reprocessing of aluminum slags insures the dilution of salts and their regeneration-conditions using an exothermic effect for the drying of aluminum products.

The apparatus insures the mechanical separation of large-sized materials by means of their simultaneous crumbling and screening. It features a compact design and/or construction, giving considerable savings in the field of transportation, building of equipment, labor and power, while the final technical, technological and economical effect is substantially higher than the sum of effects provided by the three chambers of the drum if they were employed as independent apparatus/or elements.

Figure 6:
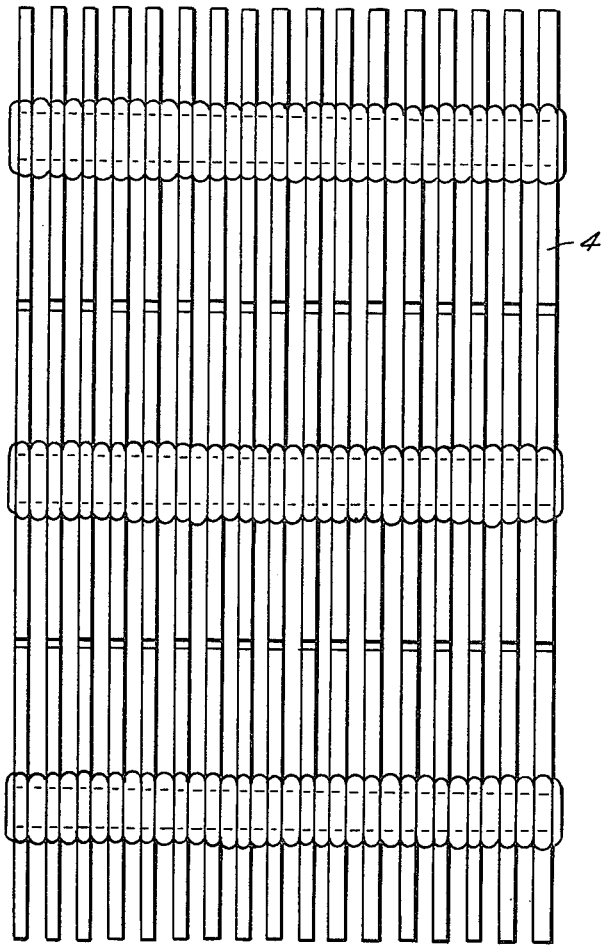
Figure 8:
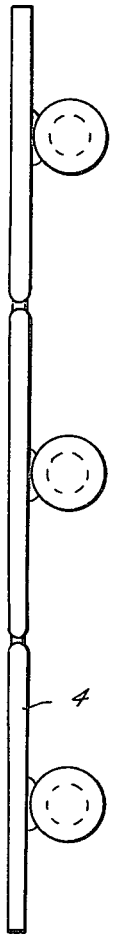
Figure 7:
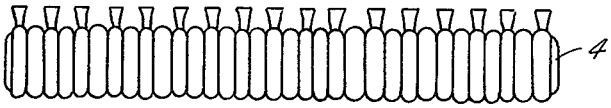

FIGS. 6, 7, and 8 are views in plan, end elevation, and side elevation, respectively, of a slotted screen employed in the apparatus of the invention.

Figure 1:
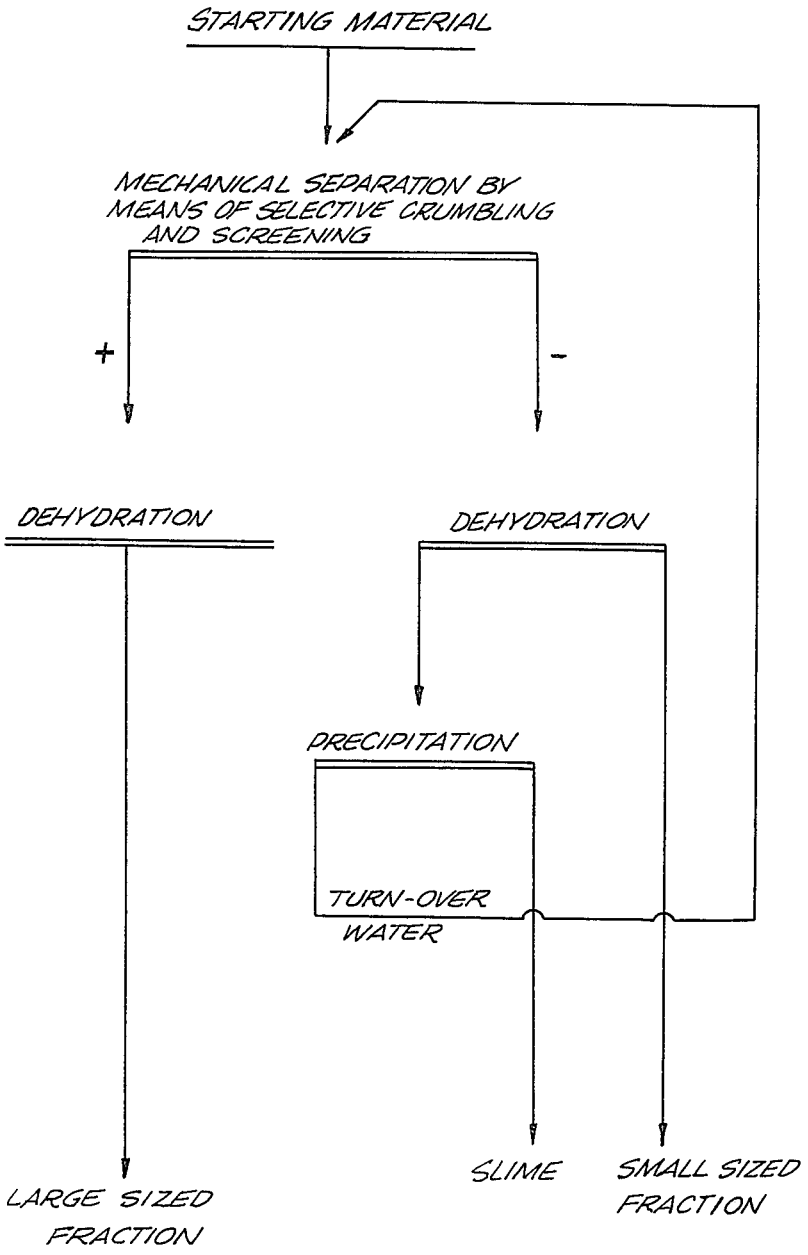
FIG. 1 is an illustrative diagram of the method in accordance with the invention for the separation of different large sized materials.
Figure 2:
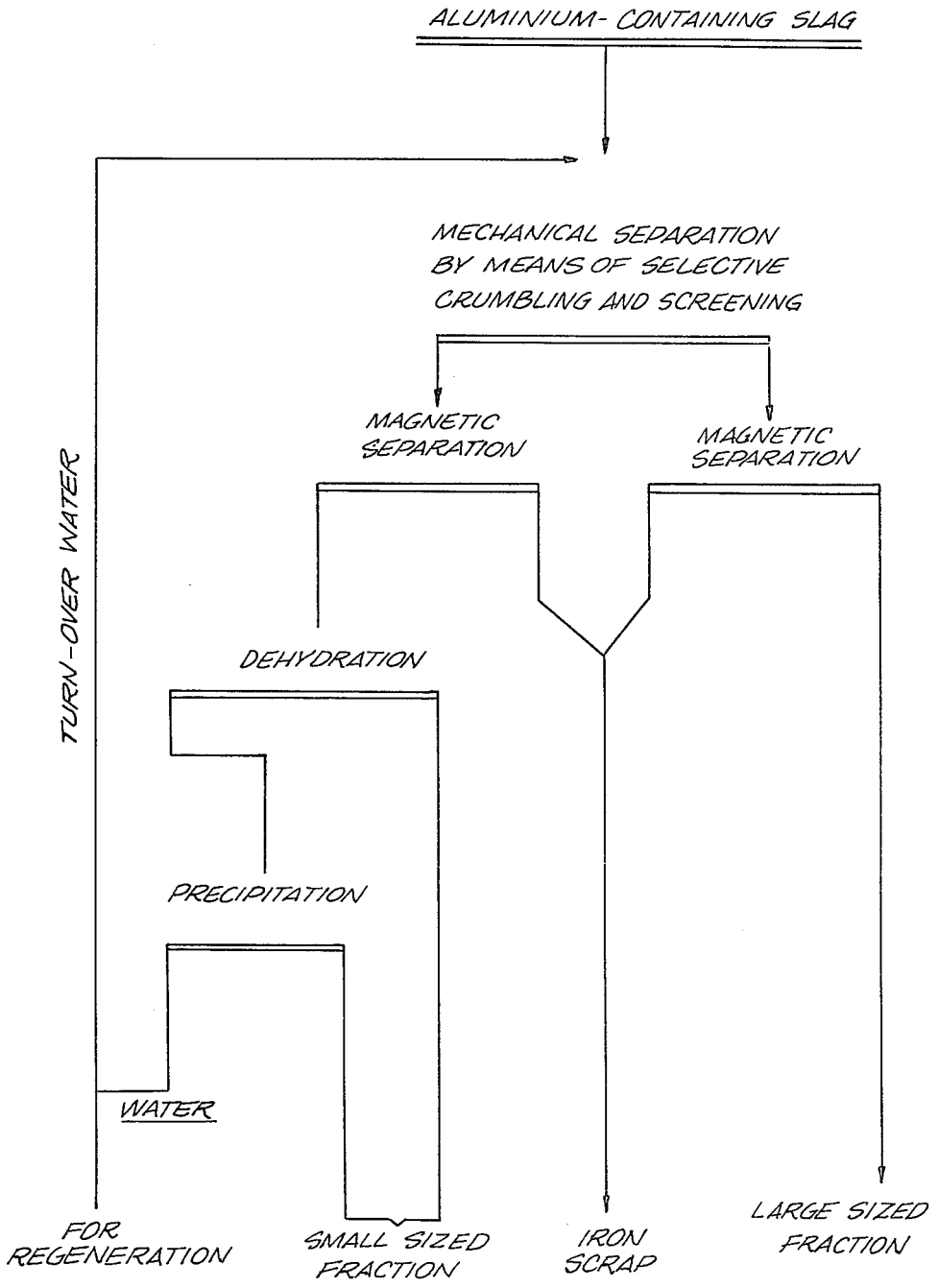
FIG. 2 is an illustrative diagram of the method of the invention for the separation of aluminum-containing slag.

The flow diagrams of FIGS. 1 and 2 are self-explanatory.

Figure 3:
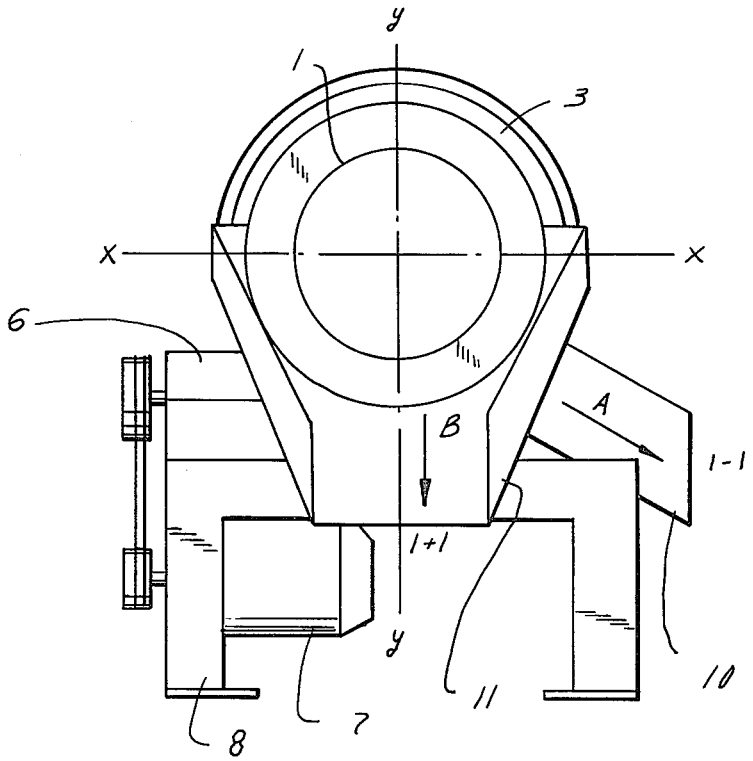
FIG. 3 is a front view of the apparatus of the invention.
Figure 4:
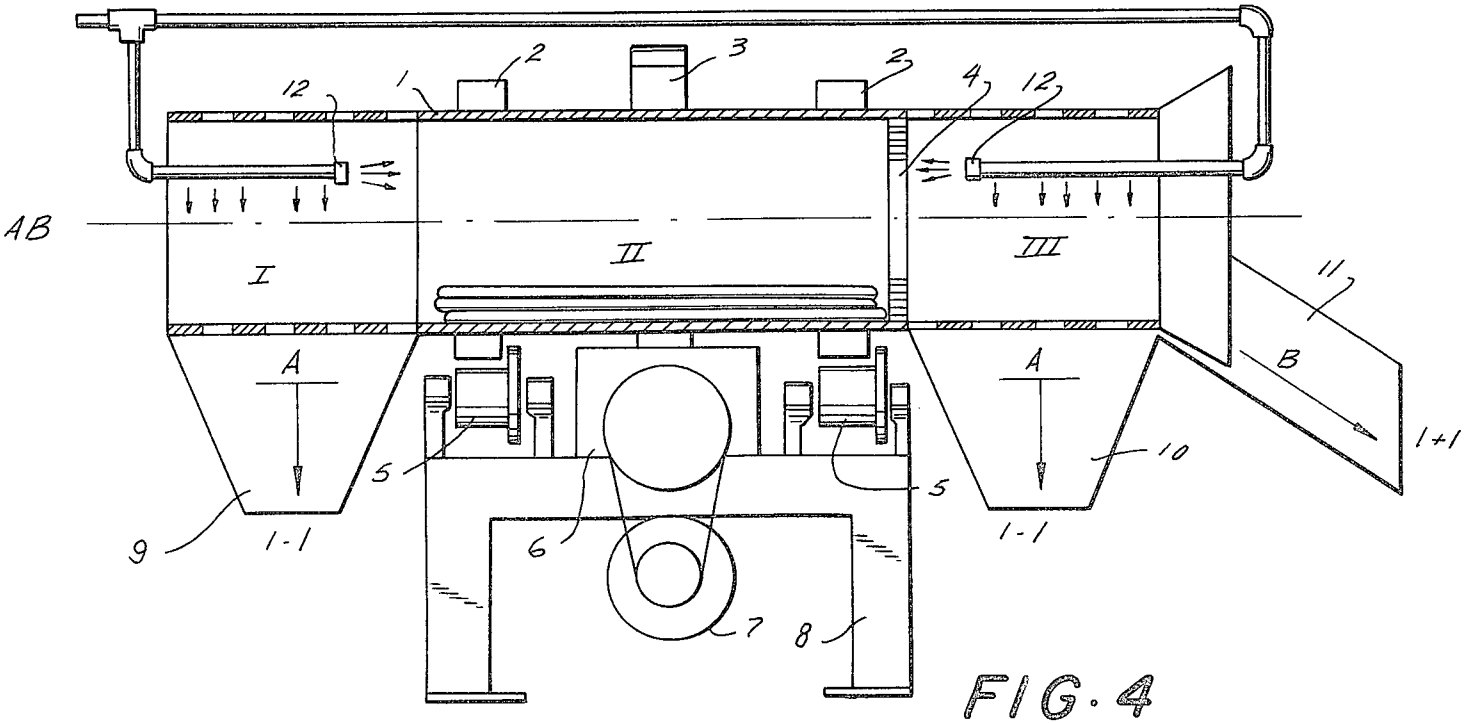
FIG. 4 is a view in cross-section taken along the line Y—Y in FIG. 3.
Figure 5:
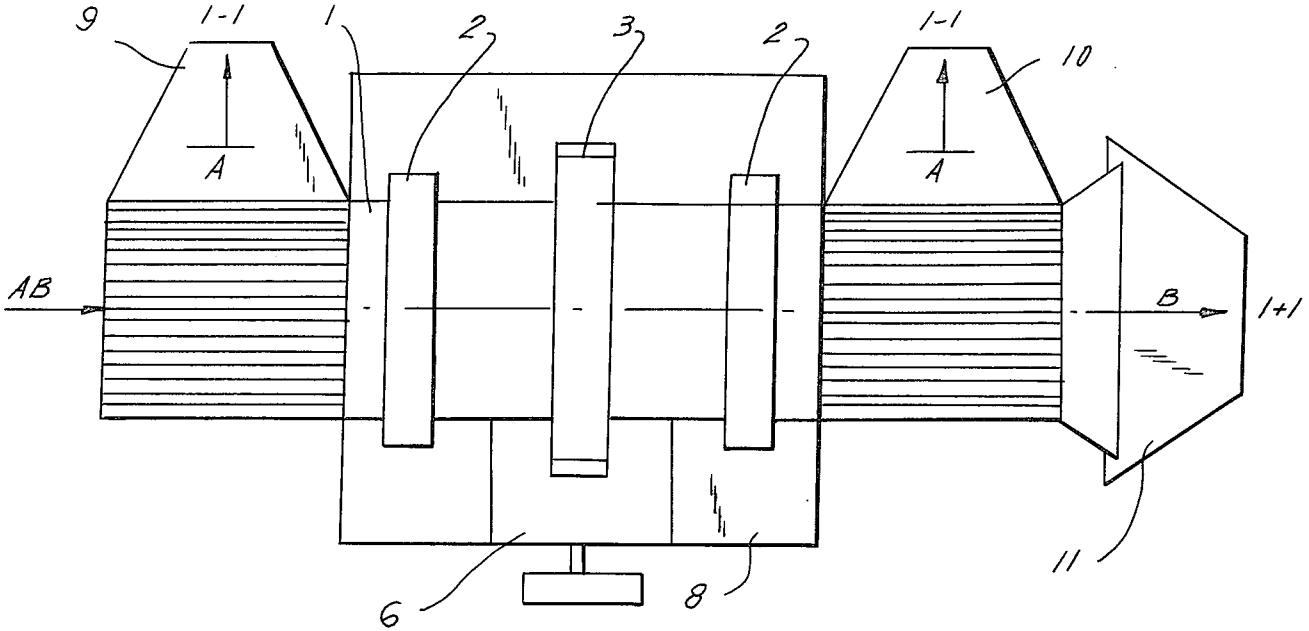
FIG. 5 is a top view of the apparatus of FIGS. 3 and 4.

Turning now to FIGS. 3, 4, and 5, as shown in FIG. 4 the equipment comprises a cylindrical body 1 including three working chambers I, II, and III. Between the chamber II and III there is mounted a slotted screen 4.

The outer side of the drum has two shroud wheels 2 and a ring gear 3 fixed thereon. The shroud wheels 2 rest on four freely rotating rollers 5, while the driving of the ring gear is effected by means of a speed-reducing transmission 6 and an electrical motor 7. The rollers 5, the reducer 6, and the motor 7 are mounted on a frame 8. The screen underflow products A are withdrawn from the apparatus through the chutes 9 and 10, while the screen overflow product B is discharged through the chute 11. The material in chambers I and III is subjected to sprays of large amounts of water by water spraying means 12, as shown.

The equipment is operated by the following way:

The material AB intended for reprocessing procedures is supplied to the chamber I of the drum or body 1 which is slightly, and axially sloped downwardly in the direction of material-flow (from left to right in FIG. 4). Under the effect of the rotary motion of chamber I, the preliminary screening of the starting small sized feedstock is implemented. The thus delivered larger particles are fed from chamber I to chamber II wherein 3 to 10 steel rods 14 are disposed.

The weight and diameter of the rods 14 are so selected as not to re-crush large—(metal)—particles but just to crumble down the non-metal or softer inclusions. This is achieved by the slightly cascading motion of the rods 14 within the material. The thus-treated material is passed through the slotted screen 4 and, through its central opening, flows to chamber III. In chamber III there occurs the final separation of the crumbled, small sized materials as a screen underflow product from the large pieces, which constitute the screen overflow product. The screen underflow products are evacuated from the apparatus via the chutes 9 and 10, while the screen overflow products are discharged through the chute 11.

To illustrate the invention, the following examples are given:

EXAMPLE 1

A batch of 100 tons of dry aluminum slag, with particles of pieces up to 200 mm in size was supplied to the apparatus of FIGS. 3, 4 and 5 for mechanical separation by means of selective crumbling and screening under conditions of intensive water-spraying and screening, resulting in the separation of the metal fraction from the oxide fraction.

The metal fraction was submitted to magnetic separation, whereupon two products were obtained: a metal-aluminum product-56 tons sized +3−250 mm, and having an aluminum content of 82% by weight, and an iron-scrap product in the amount of 14.0 tons, sized +3−250 mm and having an iron content: Fe=78% by weight.

The separated oxide fraction in the form of a water-suspension was submitted to magnetic separation, resulting in small size iron scrap amounting to 1.0 ton having a 3 mm particle size and an iron content of 66% of weight.

The oxide-fraction from which iron inclusions have been removed was dehydrated in a spiral classifier, resulting in aluminum oxides amounting to 26.0 tons, sized −3+0.08 mm, with an aluminum content of 63% by weight.

The water separated from the oxides was submitted to a mechanical-impurities cleaning, whereupon aluminum slime (oxide) was obtained amounting to 3.0 tons, having a particle size of 0.08 mm and an aluminum content of 31% by weight.

The thus obtained products are used in the following ways:

the metal aluminum product was used to produce aluminum pigs; the iron scrap, including the small sizes thereof, was used as feedstock for the iron and steel industry; the aluminum oxide, including the aluminum slime, was used for the manufacturing of technical aluminum sulphate; finally, the tailing waters were utilized as turn-over fluids in the technological process.

EXAMPLE 2

A batch of 100 tons of salted aluminum-slags was supplied to the apparatus of FIGS. 3, 4 and 5 for mechanical separation by means of selective scrumbling and screening under intensive water-spraying conditions, resulting in the separation of metal and oxide fractions and salted solutions.

The metal fraction was submitted to magnetic separation resulting in two products: a metal-aluminum product amounting to 7 tons, and sized +3 mm with an aluminum content of 78% by weight and iron scrap amounting to 6 tons, sized +3 mm, with an iron content of 80% by weight.

The separated oxide-fraction in water suspension-form was submitted to magnetic separation, resulting in small size iron scrap amounting to 0.5 ton, sized −3 mm, and having an iron content of 64% by weight.

The oxide-fraction from which iron inclusions have been removed was dehydrated in a spiral classifier, resulting in aluminum oxides amounting to −3.5 tons, sized 3 mm, with an aluminum content of 58% by weight.

The separated water-salted solution (aqueous-salt solution) of the oxides was submitted to a purification to rid it of magnetic impurities, and was afterwards submitted to crystallization in order to regenerate the salts according to the known methods.

The products obtained were used in the following way:

the metal-aluminum product was used for producing aluminum pigs; the iron scrap—as a feedstock for the iron and steel industry; the aluminum oxide—for the production of technical aluminum suphate; and, the salted waters—for the production of salts. The yield of the obtained products depends upon the nature of the reprocessed aluminum slag.

Although the invention is illustrated and described with reference to a plurality of preferred embodiments thereof, it is to be expressly understood that it is no way limited to the disclosure of such a plurality of preferred embodiments, but is capable of numerous modifications within the scope of the appended claims.

What is claimed is:

1. A method of separation of large sized minerals containing salt, low hardness mineral inclusions and iron products, comprising subjecting said minerals to a preliminary screening under intensive water-spraying conditions to divide said minerals into an unscreened fraction and a first screened fraction, selectively and mechanically crumbling said unscreened fraction to crumble said low hardness mineral inclusions, and further screening under intensive water spraying conditions said selectively crumbled unscreened fraction to divide said minerals into a second screened fraction and an unscreened fraction removing said iron products from each of said second screened fraction and of said selectively crumbled unscreened fraction by magnetic separation, dehydrating each of said fractions and recovering the spray water from said second screened fraction during said dehydrating, and subjecting the thus-recovered spray water to salt extraction.

2. The method of claim 1 wherein the materials treated are aluminum-containing slags.

* * * * *